US006122811A

United States Patent [19]

Shirley

[11] Patent Number: 6,122,811

[45] Date of Patent: Sep. 26, 2000

[54] DRIVE TRAIN SUPPORT TOOL

[76] Inventor: Samuel C. Shirley, Box 642, Walnut, Iowa 51577

[21] Appl. No.: 09/218,319

[22] Filed: Dec. 22, 1998

[51] Int. Cl.[7] ..... B25B 27/14

[52] U.S. Cl. ..... 29/281.1; 254/133 R

[58] Field of Search ..... 254/101, 133 R, 254/131, 100, 92, 102; 269/60, 71; 29/281.1

[56] References Cited

U.S. PATENT DOCUMENTS

| | | | |
|---|---|---|---|
| 1,326,960 | 1/1920 | Petrie . | |
| 1,514,262 | 11/1924 | Santmyer | 254/133 R |
| 2,865,585 | 12/1958 | Beyer et al. | 254/100 |
| 3,222,030 | 12/1965 | Thorpe | 254/100 |
| 3,722,057 | 3/1973 | Barnes . | |
| 3,793,718 | 2/1974 | Okazaki . | |
| 3,902,236 | 9/1975 | Deem | 254/100 |
| 4,151,822 | 5/1979 | Miura et al. . | |
| 4,183,511 | 1/1980 | Marek | 269/60 |
| 4,218,939 | 8/1980 | Castoe . | |
| 4,683,632 | 8/1987 | Kalman . | |
| 4,804,162 | 2/1989 | Rice . | |
| 4,845,818 | 7/1989 | Perry . | |
| 4,914,940 | 4/1990 | Hebert | 254/100 |
| 5,139,233 | 8/1992 | Goss . | |
| 5,212,861 | 5/1993 | Bevills . | |
| 5,806,836 | 9/1998 | Wilson | 254/133 R |
| 5,926,882 | 7/1999 | Veith et al. | 269/71 |
| 5,971,362 | 10/1999 | Clark | 254/101 |
| 5,984,160 | 11/1999 | Santa Cruz et al. | 269/71 |

*Primary Examiner*—Stephen F. Gerrity
*Assistant Examiner*—Lee Wilson
*Attorney, Agent, or Firm*—Zarley, McKee, Thomte, Voorhees & Sease

[57] ABSTRACT

A drive train support tool is provided for supporting drive train components in a motor vehicle. The tool includes a tubular body having opposite ends, with extension members telescopically extending from the opposite ends of the body. A hook is provided on each extension member for hooking over the torsion bars or other suspension system components or opposite sides of the vehicle frame. A jack extends through the tubular body and can be threadably extended into a supportive engagement with the drive train component (s). Therefore, the tool will support the engine or any other drive train component while another drive train part is removed for work or repair at a location away from the vehicle.

16 Claims, 3 Drawing Sheets

DRIVE TRAIN SUPPORT TOOL

BACKGROUND OF THE INVENTION

Various types of floor jacks and support stands are well known for supporting drive train components for work by a mechanic. For example, a small hydraulic floor jack can be positioned beneath the vehicle and raised so as to support the various drive train components while a mechanic lies on his or her back on a creeper or crawler to get beneath the vehicle. Other larger and more complex supports can be utilized with hydraulic floor hoists which raise the entire vehicle to a height where the mechanic can walk beneath the vehicle. While such a hydraulic floor hoist provides increased mobility for the mechanic, as compared to lying on a crawler, any drive train support which rests upon the floor inhibits movement of the mechanic beneath the vehicle. Also, such large floor model drive train supports take up large space for storage when not in use. Furthermore, such floor model supports must remain in place until the work on the drive train is completed. Thus, when using floor model supports, the vehicle must remain on the hoist even after a part of the vehicle, such as the transmission, engine, or transfer case is removed for work or repair.

Accordingly, a primary objective of the present invention is the provision of a simple and improved tool for supporting various drive train components in a vehicle, whether on or off of a floor hoist, during the removal, repair and/or replacement of drive train components.

Another objective of the present invention is a provision of a drive train support tool which is mounted on the vehicle frame or suspension system components, without the need to support it from the floor or ground.

A further objective of the present invention is a provision of a drive train support tool which is small in size for easy handling and storage.

Still another objective of the present invention is the provision of a drive train support tool which can be used on numerous makes and models of vehicles.

A further objective of the present invention is the provision of a drive train support tool which can be used on vehicles having the drive train centrally positioned on the vehicle frame and on vehicles having the drive train positioned off-center with respect to the vehicle frame.

Another objective of the present invention is the provision of a drive train support tool which is economical to manufacture, and durable and safe in use.

These and other objectives will be apparent from the following description of the invention.

SUMMARY OF THE INVENTION

A tool is provided for supporting various drive train components both individually and/or in combination. The vehicle includes a frame with opposite sides and/or opposite suspension system components. The tool includes a cross bar comprised of a tubular body with extension members telescopically extending from the opposite ends of the body. A hook is provided on each extension member such that the cross bar can be hooked over the torsion bars or other suspension system components, or sides of the vehicle frame. A jack threadably extends through the tubular body and is adapted to be extended into supportive engagement with the engine. The jack is actuated with a wrench or socket.

DETAILED DESCRIPTION OF THE INVENTION

Figure 1:
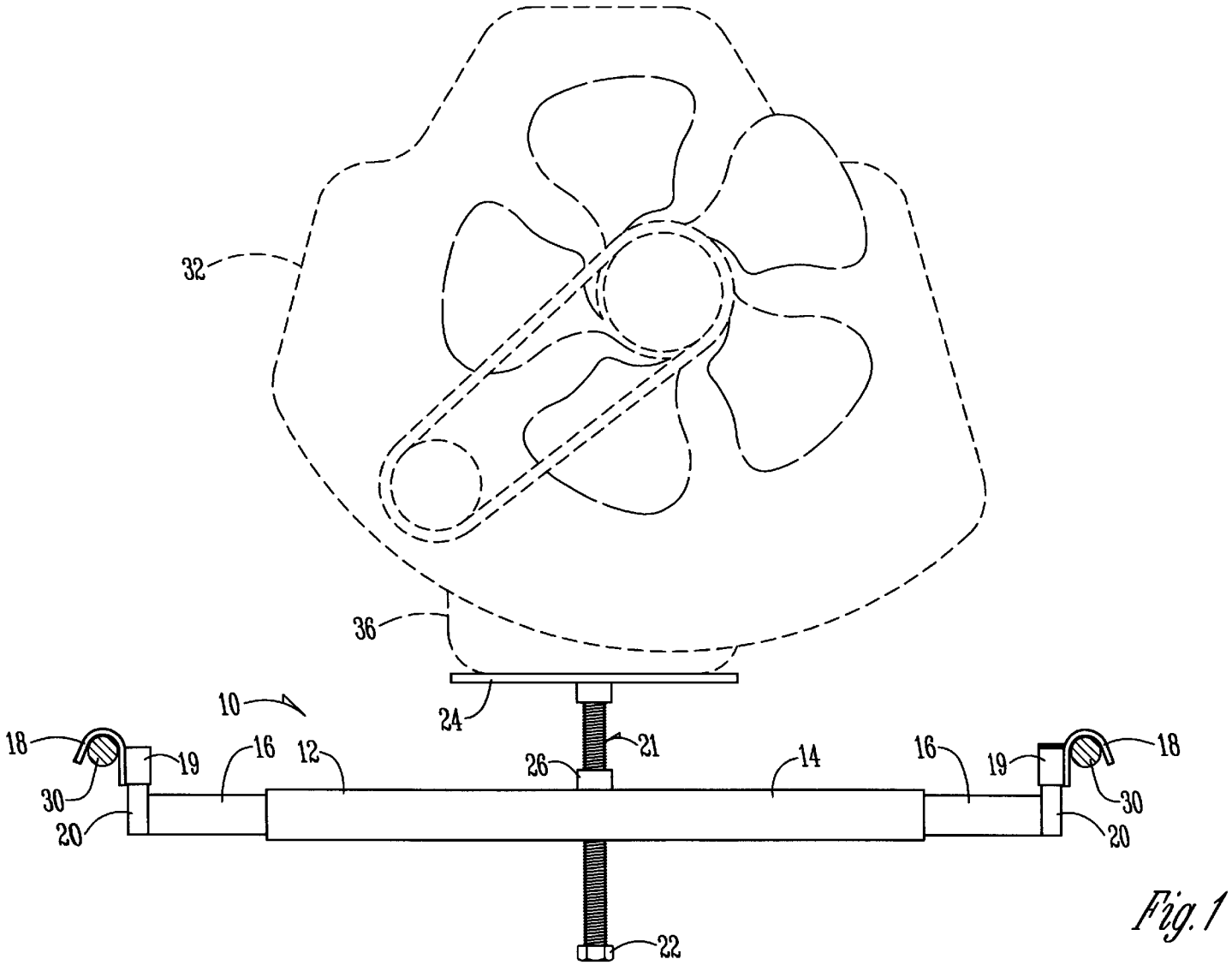
FIG. 1 is an elevation view showing the drive train support tool of the present invention in use.
Figure 2:
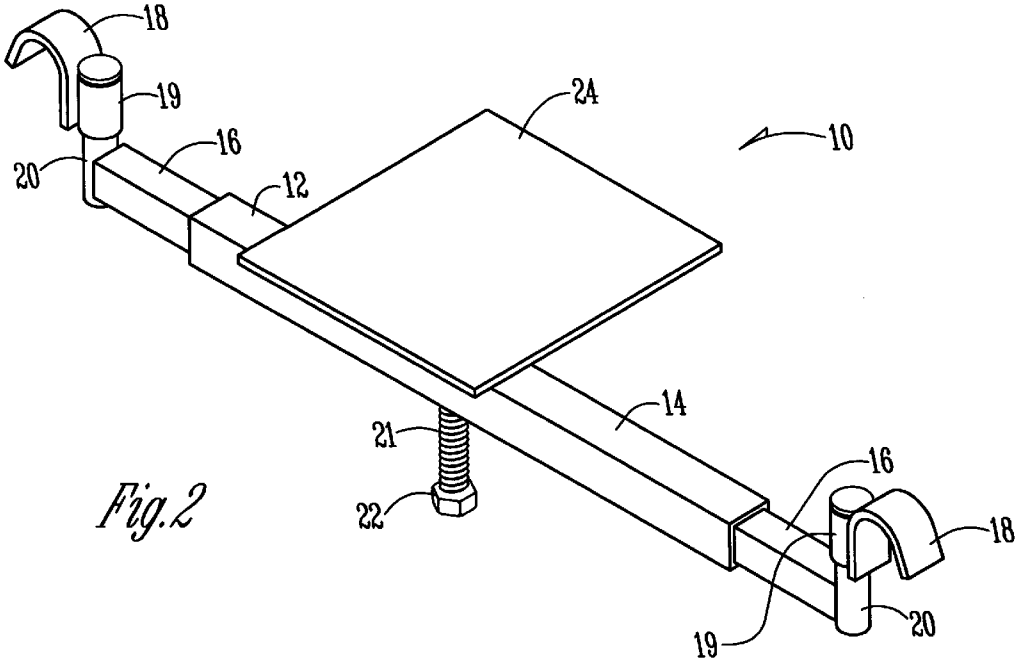
FIG. 2 is a perspective view of the drive train support tool of the present invention.
Figure 3:
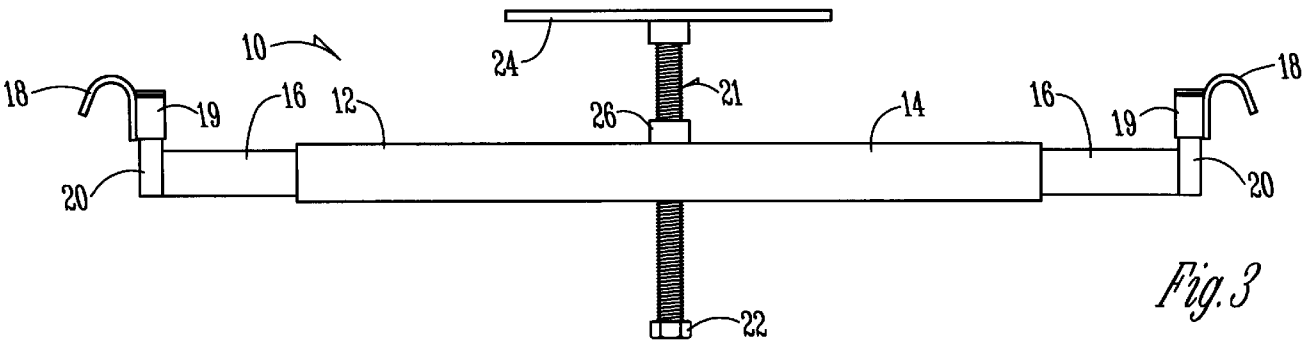
FIG. 3 is an elevation view of the drive train support tool of the present invention.
Figure 4:
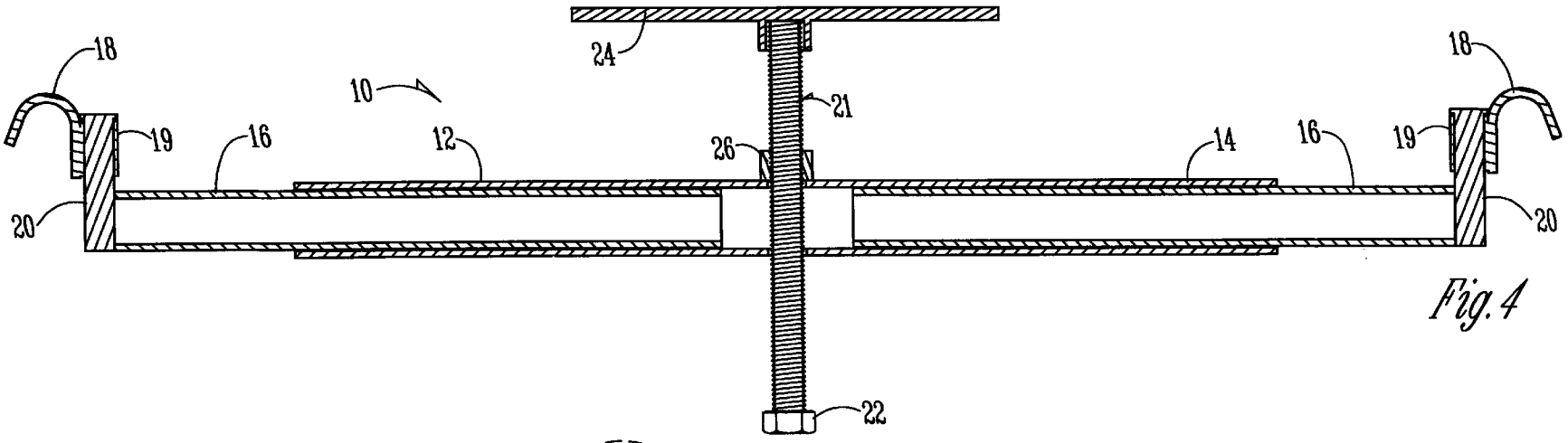
FIG. 4 is a sectional view taken along the length of the tool.

The drive train support tool of the present invention is generally designated by the reference numeral 10 in the drawings. The tool includes a cross bar 12 comprised of a tubular body 14 and extension members 16 which telescopically extend from each end of the tubular body 14. Thus, the length of the cross bar 12 can be lengthened or shortened by extending or retracting one or both of the extension members 16. The extension members 16 are independent of one another.

A hook 18 is pivotally mounted on the outer end of each extension member 16. More particularly, each hook 18 includes a collar 19 which is rotatably mounted on a shaft 20 welded or otherwise attached to the end of each extension member 16. Thus, the hooks 18 can be angularly positioned with respect to the longitudinal axis of the cross bar 12 by rotation about the shaft 20. The hooks 18 are adapted to hook over the torsion bars or other suspension system components 30 of the vehicle, as described below.

A screw jack 21 extends through the tubular body 14. The lower end of the screw jack 21 has a head 22 adapted to receive a wrench or socket for turning the screw jack 21. The upper end of the screw jack includes a plate 24 for engaging the engine. The plate 24 may be loosely set upon the screw jack 21 or threaded onto the jack. The screw jack 21 threadably extends through a threaded collar or bolt 26 welded onto the tubular body 14.

Figure 5:
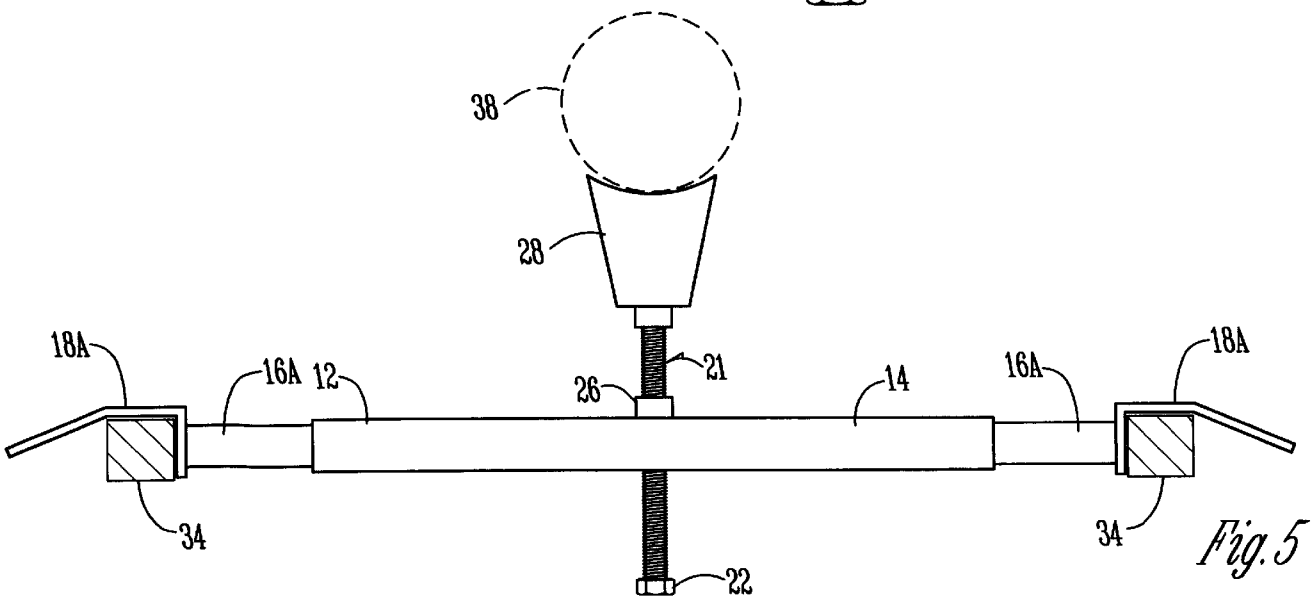
FIG. 5 is a view of the drive train support tool of the present invention having an alternative jack head and alternative hooks.

As an alternative to the head plate 24, the screw jack 21 may be provided with a saddle 28, as shown in FIG. 5, for engaging a curved portion of the drive train, such as the transmission or transfer case. As a further alternative, shown in FIG. 5, the extension members 16 may be replaced with modified members 16A having modified hooks 18A attached thereto. Hooks 18A are adapted to fit over opposite sides of the vehicle frame 34, as described below.

In use, the cross bar is hung from the torsion bars or other suspension system components 30 of the vehicle by the hooks 18. Alternatively, the cross bar can be hung on the opposite sides of the vehicle frame 34 using the hooks 18A. If the hooks 18 and 18A do not fit a particular vehicle, the cross bar 12 can be suspended from the vehicle frame or suspension system using chains (not shown). Since the length of the cross bar 12 is adjustable, the tool 10 can be used on any make or model vehicle. Also, since the extension members 16, 16A are independently adjustable, the screw jack can be centered or offset to accommodate the position of any drive train component. After the cross bar 12 is mounted on the torsion bars 30 or on the sides of the vehicle frame 34, the jack 21 is extended such that the plate 24 or saddle 28 engages the drive train component. For example, plate 24 may engage the oil pan 36 or the saddle 28 may engage the transfer case 38 of the drive train. Thus, the weight of the drive train is supported by the cross bar 12. Parts of the drive train not supported by the tool 10 can be removed for work or repair at a location away from the vehicle.

When the vehicle is raised on a hydraulic floor hoist to a height sufficient for the mechanic to walk beneath the vehicle, the tool 10 allows unobstructed access to the drive train by the mechanic, since the tool does not engage the floor or ground. For example, with the transmission and/or transfer case removed, and the engine supported by the tool 10, the hoist can be lowered and the vehicle moved from the hoist, while the removed part or parts are being repaired, thus freeing the hoist for use with another vehicle. Also, if necessary, more than one tool 10 can be used to support the drive train at different locations, and/or at different steps in the process.

The preferred embodiment of the present invention has been set forth in the drawings and specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A tool for supporting a drive train component in a vehicle having opposing suspension components, the tool comprising:

a tubular body having opposite ends;

extension members telescopically extending in opposite lateral directions from the opposite ends of the body;

a hook on each extension member for hooking over the suspension components and which are not laterally movable relative to the extension members; and a jack extending through the body for supportive engagement of the drive train component.

2. The tool of claim 1 wherein the jack has a lower end with a head adapted to receive a wrench or socket for extending or retracting the jack relative to the body.

3. The tool of claim 1 wherein the jack has an upper end with a plate for engaging the drive train component.

4. The tool of claim 1 wherein the jack has an upper end with a saddle for engaging the drive train component.

5. The tool of claim 1 wherein the hooks are pivotally connected to each extension member for rotation about a vertical axis.

6. The tool of claim 1 wherein the extension members are independent of one another.

7. The tool of claim 1 wherein the tubular body is free from any floor support.

8. The tool of claim 1 wherein the extension members are free from locking hardware.

9. The tool of claim 1 wherein the hooks each have an end section extending downwardly so as to retentively engage the suspension components to prevent lateral movement of the hooks.

10. The tool of claim 1 wherein the tubular body and extension members are square in cross section.

11. The tool of claim 1 wherein the hooks are mounted at the ends of the extension members.

12. A method of supporting a drive train component of a motor vehicle, the vehicle having suspension system components, the method comprising:

extending opposite telescoping ends of a cross bar to a width substantially equal to a distance between the suspension system components;

suspending the cross bar on the suspension system components using hooks on the opposite ends of the cross bar which are not laterally movable relative to the telescoping ends, such that the bar extends beneath the drive train component; and extending a jack on the cross bar into engagement with the drive train component such that the weight of the drive train component is supported by the cross bar and the suspension system components.

13. The method of claim 12 further comprising maintaining an area beneath the drive train component free from floor support.

14. The method of claim 12 further comprising precluding lateral movement of the ends of the cross bar without use of locking hardware.

15. The method of claim 12 further comprising rotating the hooks into alignment with the suspension system components.

16. The method of claim 12 further comprising extending a portion of the hooks downwardly over the suspension system components to preclude lateral movement of the hooks.

* * * * *